US008435443B2

(12) United States Patent
Nazmy et al.

(10) Patent No.: US 8,435,443 B2
(45) Date of Patent: May 7, 2013

(54) HIGH-TEMPERATURE ALLOY

(75) Inventors: Mohamed Youssef Nazmy, Fislisbach (CH); Andreas Kuenzler, Baden (CH); Markus Staubli, Dottikon (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 12/199,877

(22) Filed: Aug. 28, 2008

(65) Prior Publication Data

US 2009/0060774 A1 Mar. 5, 2009

(30) Foreign Application Priority Data

Aug. 30, 2007 (CH) ..... 1355/07

(51) Int. Cl.
*C22C 38/22* (2006.01)

(52) U.S. Cl.
USPC ..... 420/40; 148/325; 148/609; 374/208

(58) Field of Classification Search ..... 420/8, 34, 420/62–64, 67–70, 77, 79, 81, 121, 123–125, 420/127, 40; 148/320, 325, 579, 605, 609; 374/208
See application file for complete search history.

(56) References Cited

U.S. PATENT DOCUMENTS 5,286,442 A * 2/1994 Uematsu et al. ..... 420/40
6,499,943 B1 * 12/2002 Beeck et al. ..... 415/115

FOREIGN PATENT DOCUMENTS

| | | |
|---|---|---|
| CN | 1644749 A | 7/2005 |
| EP | 0061322 | 9/1982 |
| EP | 0516267 | 12/1992 |
| EP | 0573343 | 12/1993 |
| EP | 0592667 | 4/1994 |
| EP | 1076157 | 2/2001 |
| JP | 4128344 | 4/1992 |
| JP | 4141558 | 5/1992 |
| JP | 5331552 | 12/1993 |
| JP | 6212363 | 8/1994 |
| JP | 8299808 | 11/1996 |
| JP | 2000-055729 | 2/2000 |
| JP | 2000055739 | 2/2000 |
| JP | 2000055741 | 2/2000 |
| WO | WO01/49441 | 7/2001 |
| WO | WO2004/104257 | 12/2004 |
| WO | WO2005/080622 | 9/2005 |

OTHER PUBLICATIONS

Search Report for Swiss Patent App. No. 1355/2007 (Oct. 28, 2007).
Search Report for European Patent App. No. 08163031.1 (Nov. 7, 2008).

* cited by examiner

*Primary Examiner* — Steven Bos
*Assistant Examiner* — Brian Walck
(74) *Attorney, Agent, or Firm* — Cermak Nakajima LLP; Adam J. Cermak

(57) ABSTRACT

An iron-based high-temperature alloy has the following chemical composition (values given being in % by weight):
20 Cr,
4 to 8 Al,
at least one of the elements Ta and Mo with a sum of 4 to 8,
0-0.2 Zr,
0.02-0.05 B,
0.1-0.2 Y,
0-0.5 Si,
remainder Fe.
The alloy can be produced at low cost and is distinguished in comparison with the known prior art by outstanding oxidation resistance and good mechanical properties at high temperatures up to 1000° C.

13 Claims, 5 Drawing Sheets

HIGH-TEMPERATURE ALLOY

This application claims priority under 35 U.S.C. §119 to Swiss application no. 01355/07, filed 30 Aug. 2007, the entirety of which is incorporated by reference herein.

BACKGROUND

1. Field of Endeavor

The invention relates to the field of materials engineering. It concerns an iron-based high-temperature alloy, which contains about 20% by weight Cr and several % by weight Al, as well as small amounts of other constituents, and which has good mechanical properties and very good oxidation resistance at operating temperatures up to 1000° C.

2. Brief Description of the Related Art

For some time, iron-based ODS (oxide-dispersion-strengthened) materials, for example ferritic ODS FeCrAl alloys, have been known. On account of their outstanding mechanical properties at high temperatures, they are used with preference for components that are subjected to extreme thermal and mechanical stress, for example for gas turbine blades.

ALSTOM uses such materials for tubes to protect thermocouples, which are used, for example, in gas turbines with sequential combustion for temperature control and are exposed there to extremely high temperatures and oxidizing atmospheres.

The nominal chemical compositions are specified (in % by weight) in Table 1 for known ferritic iron-based ODS alloys:

TABLE 1

Nominal composition of known ODS-FeCrAlTi alloys

| Alloy designation | Constituent | | | | | |
|---|---|---|---|---|---|---|
| | Fe | Cr | Al | Ti | Si | Addition of reactive elements (in the form of an oxide dispersion) |
| Kanthal APM | Rem. | 20.0 | 5.5 | 0.03 | 0.23 | $ZrO_2$—$Al_2O_3$ |
| MA 956 | Rem. | 20.0 | 4.5 | 0.5 | — | $Y_2O_3$—$Al_2O_3$ |
| PM 2000 | Rem. | 20.0 | 5.5 | 0.5 | — | $Y_2O_3$—$Al_2O_3$ |

The operating temperatures of these metallic materials reach up to about 1350° C. They have potential properties that are more typical of ceramic materials.

The materials mentioned have very high creep rupture strengths at very high temperatures and also provide outstanding high-temperature oxidation resistance by forming a protective $Al_2O_3$ film, as well as a high resistance to sulfidizing and vapor oxidation. They have highly pronounced directional-dependent properties. For example, in tubes, the creep strength in the transverse direction is only about 50% of the creep strength in the longitudinal direction.

The production of such ODS alloys is performed by powder metallurgical processes, using mechanically alloyed powder mixtures that are compacted in the known way, for example, by extrusion or by hot isostatic pressing. The compact is subsequently highly plastically deformed, usually by hot rolling, and subjected to a recrystallization annealing treatment. This type of production, but also the material compositions described, mean, inter alia, that these alloys are very expensive.

SUMMARY

One aim of the present invention is to attempt to avoid the aforementioned disadvantages of the prior art. One of numerous aspects of the present invention includes developing a material that is suitable for the applications specified above, costs less than the PM 2000 material known from the prior art, but has at least equally good oxidation resistance. Material adhering to principles of the invention is also intended to be well-suited for hot working and, as far as possible, have better mechanical properties than, for example, the known alloy KANTHAL APM, which is used for heating elements.

Another aspect of the invention includes a high-temperature alloy of the FeCrAl alloy type having the following chemical composition (values given being in % by weight):

20 Cr,
4-8 Al,
at least one of the elements from the group Ta and Mo with a total of 4-8,
0-0.2 Zr,
0.02-0.05 B,
0.1-0.2 Y,
0-0.5 Si,
remainder Fe.

With preference, the alloy contains 5 to 6% by weight Al, with particular preference 5.5 to 6% by weight Al. This forms a good protective $Al_2O_3$ film on the surface of the material, which increases the high-temperature oxidation resistance.

Further preferred ranges are 0-8% by weight Mo and 0-4% by weight Ta, where the sum (Mo+Ta)=4-8% by weight, and where, for example, the maximum value of 8% Mo only applies if no Ta is present. With particular preference, the material has 2-4% by weight Mo and/or 2-4% by weight Ta.

If the contents of (Ta+Mo) are lower than the values specified, the high-temperature strength is reduced too much; if they are higher, the oxidation resistance is reduced in an undesired way and the material also becomes too expensive.

The addition of 0.25%, at most 0.5%, by weight, Si is also advantageous, because this further increases the oxidation resistance.

With preference, 0.2% by weight Zr and 0.1% by weight Y are also present in exemplary materials according to the invention.

It has surprisingly been found that it is not necessary, as is the case with the alloys known from the prior art and described above, to add titanium. Ti and Cr act as solid-solution strengtheners. In the range of 2-8% by weight, Mo has a similar effect but is much less expensive than Ti. Added to this is the fact that, if it is added together with Zr, as is the case in preferred variants, Mo leads to improved tensile strengths and creep rupture strengths.

Ta, Zr, and B are elements that act as dispersion strengtheners. The interaction of these constituents with the other constituents, in particular the Cr and the Mo, if the latter is present, leads to good strength values, while Al, Y, and also Zr increase the oxidation resistance. Cr positively influences ductility.

BRIEF DESCRIPTION OF THE DRAWINGS

Exemplary embodiments of the invention are represented in the drawings, in which.

DETAILED DESCRIPTION OF EXEMPLARY EMBODIMENTS

The invention is explained in more detail below on the basis of exemplary embodiments and the drawings.

The ODS FeCrAl comparison alloys known from the prior art, PM 2000 and Kanthal APM (see Table 1 for their composition), as well as the alloys according to the invention listed in Table 2, were investigated with regard to the oxidation behavior and with regard to the mechanical properties at room temperature (RT) and up to 1000° C. The alloying constituents are specified in % by weight:

TABLE 2

Compositions of the investigated alloys according to the invention

| | Constituent | | | | | | | | |
|---|---|---|---|---|---|---|---|---|---|
| Alloy designation | Fe | Cr | Al | Ta | Mo | Zr | B | Y | Si |
| 2007 | Rem. | 20 | 5.5 | 4 | — | 0.2 | 0.05 | 0.1 | — |
| 2008 | Rem. | 20 | 5.5 | — | 4 | 0.2 | 0.05 | 0.1 | — |
| 2009 | Rem. | 20 | 8 | — | 4 | 0.2 | 0.05 | 0.1 | — |
| 2010 | Rem. | 20 | 6 | — | 8 | 0.2 | 0.05 | 0.1 | — |
| 2011 | Rem. | 20 | 5.5 | — | 4 | 0.2 | 0.05 | 0.1 | 0.5 |
| 2012 | Rem. | 20 | 6 | 2 | 2 | 0.2 | 0.05 | 0.1 | — |
| 2013 | Rem. | 20 | 6 | 4 | 4 | 0.2 | 0.05 | 0.1 | — |
| 2014 | Rem. | 20 | 6 | — | 4 | 0.2 | 0.05 | 0.1 | 0.5 |
| 2015 | Rem. | 20 | 5.5 | 4 | 4 | 0.2 | 0.05 | 0.1 | — |
| 2016 | Rem. | 20 | 5.5 | — | 4 | 0.2 | 0.05 | 0.1 | 0.25 |

The alloys according to the invention were produced by arc melting of the elements specified and then rolled at temperatures of 800-900° C., before, inter alia, the tensile specimens were prepared.

Figure 1:
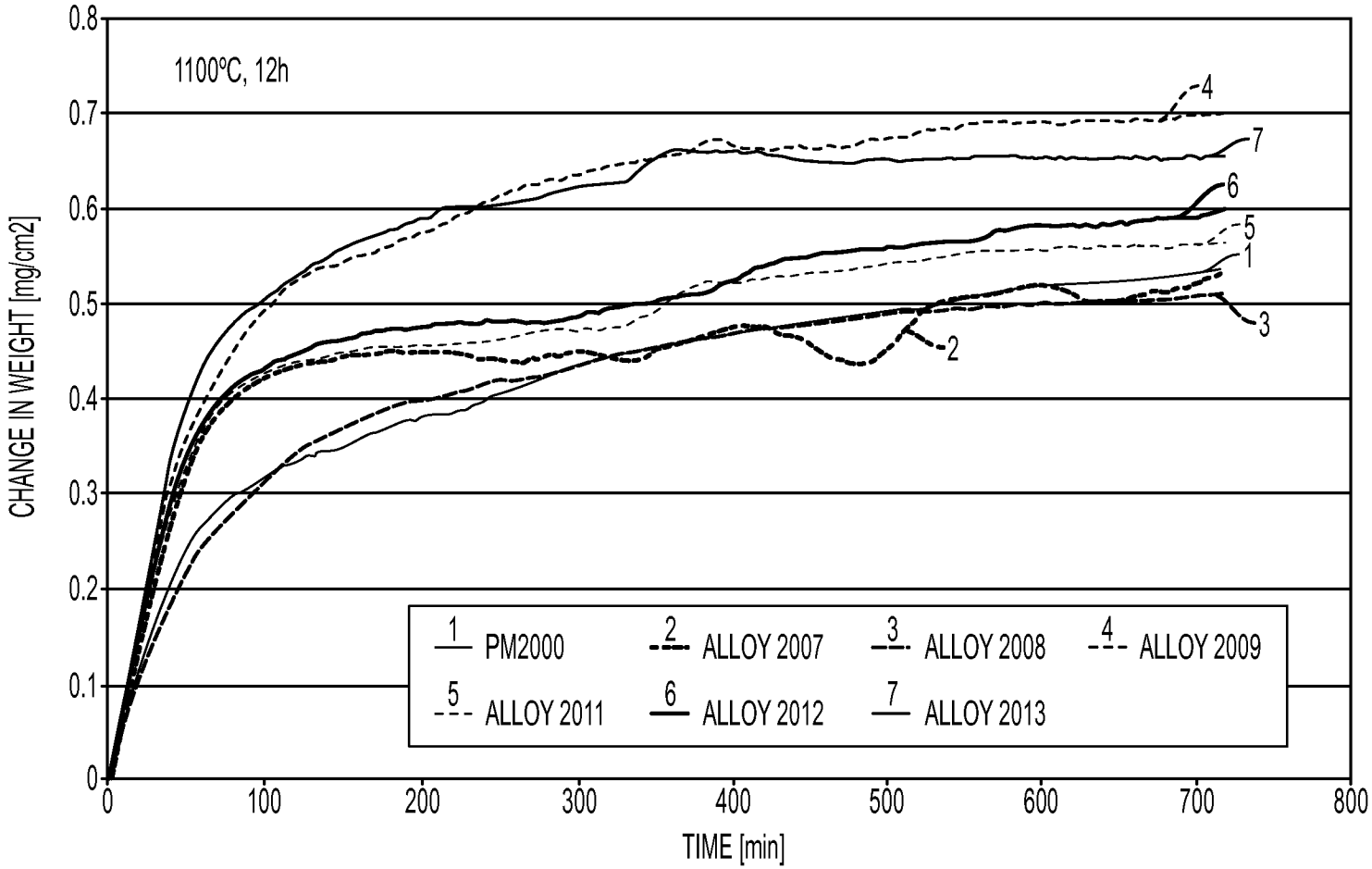
FIG. 1 shows the oxidation behavior at 1100° C./12 h for PM 2000 and for selected materials according to the invention.

In FIG. 1, the change in weight at 1100° C. is represented as a function of time over a time period of 12 hours for the alloys specified. The alloy according to the invention 2008 (inter alia, with 4% Mo and 5.5% Al) shows an oxidation behavior that is approximately comparable with the comparison alloy PM 2000 and is even somewhat better (smaller change in weight) after the long age-hardening times, while the alloy 2009 (inter alia, with 4% Mo and 8% Al) is the worst in this respect and cannot reach the values of PM 2000 at these temperatures. This is due to the comparatively high aluminum content; 8% by weight Al represents the maximum value, with 5 to 6% by weight Al being optimum.

Figure 2:
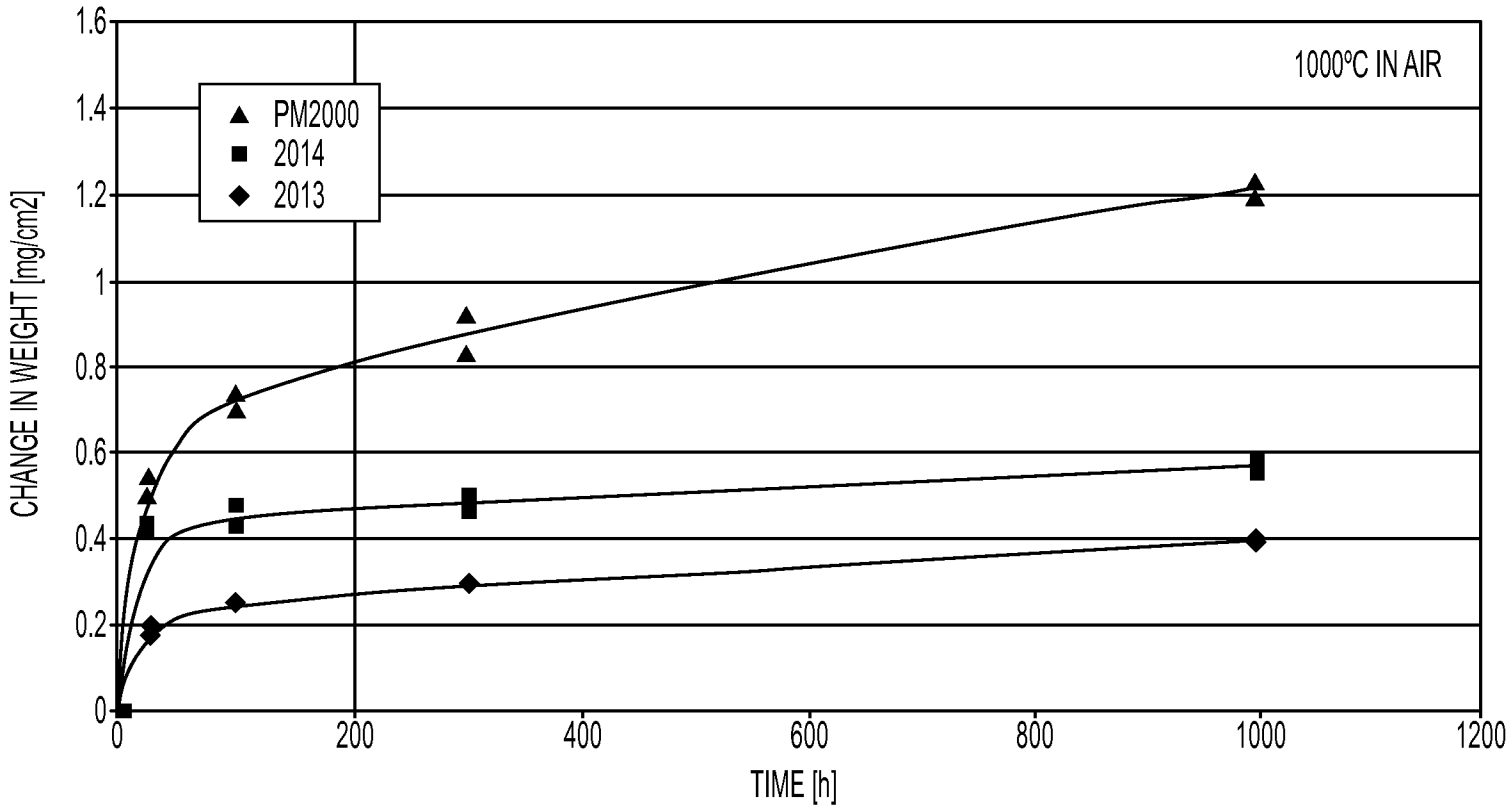
FIG. 2 shows the oxidation behavior at 1000° C. in air over a time period of 1000 hours for PM 2000 and for selected materials according to the invention.

In FIG. 2, the change in weight at 1000° C. in air is represented as a function of time over a time period of 1000 hours for the alloys specified. It is found that the two alloys according to the invention, 2014 and 2013, but in particular the alloy 2013, have a much improved oxidation behavior. After 1000 hours of age hardening in air at 1000° C., the changes in weight for the two alloys according to the invention were only one third (alloy 2013) to less than half (alloy 2014) of the change in weight by comparison of the known alloy PM 2000. Evidently a combination of Mo and Ta in equal proportions has a particularly good effect on the oxidation behavior at 1000° C. In the range specified, particularly Ta increases the activity of Al and improves the oxidation resistance.

Figure 3:
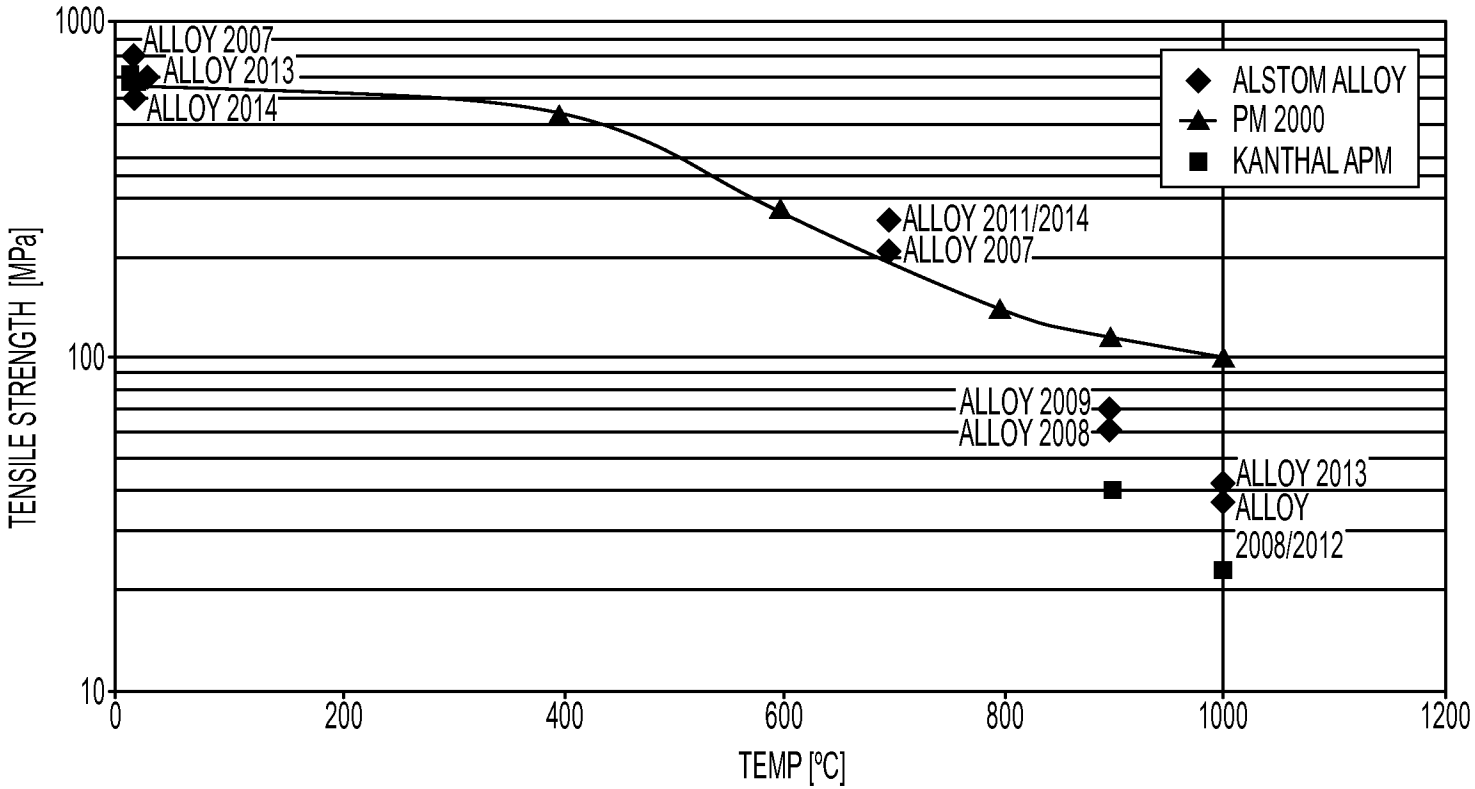
FIG. 3 shows the tensile strength in the range from room temperature to 1000° C. for PM 2000 and Kanthal APM and for selected materials according to the invention.
Figure 4:
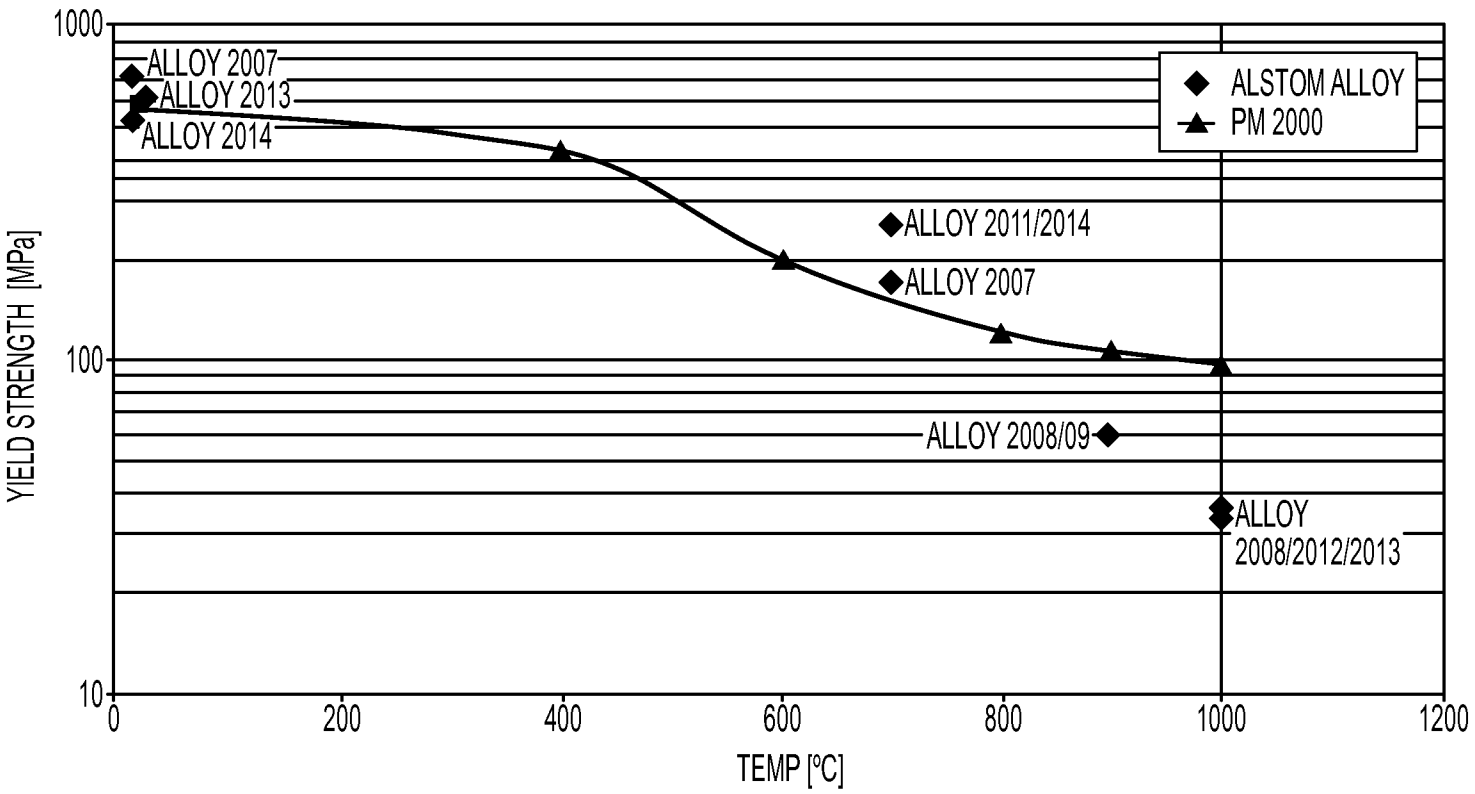
FIG. 4 shows the yield strength in the range from room temperature to 1000° C. for PM 2000 and for selected materials according to the invention.
Figure 5:
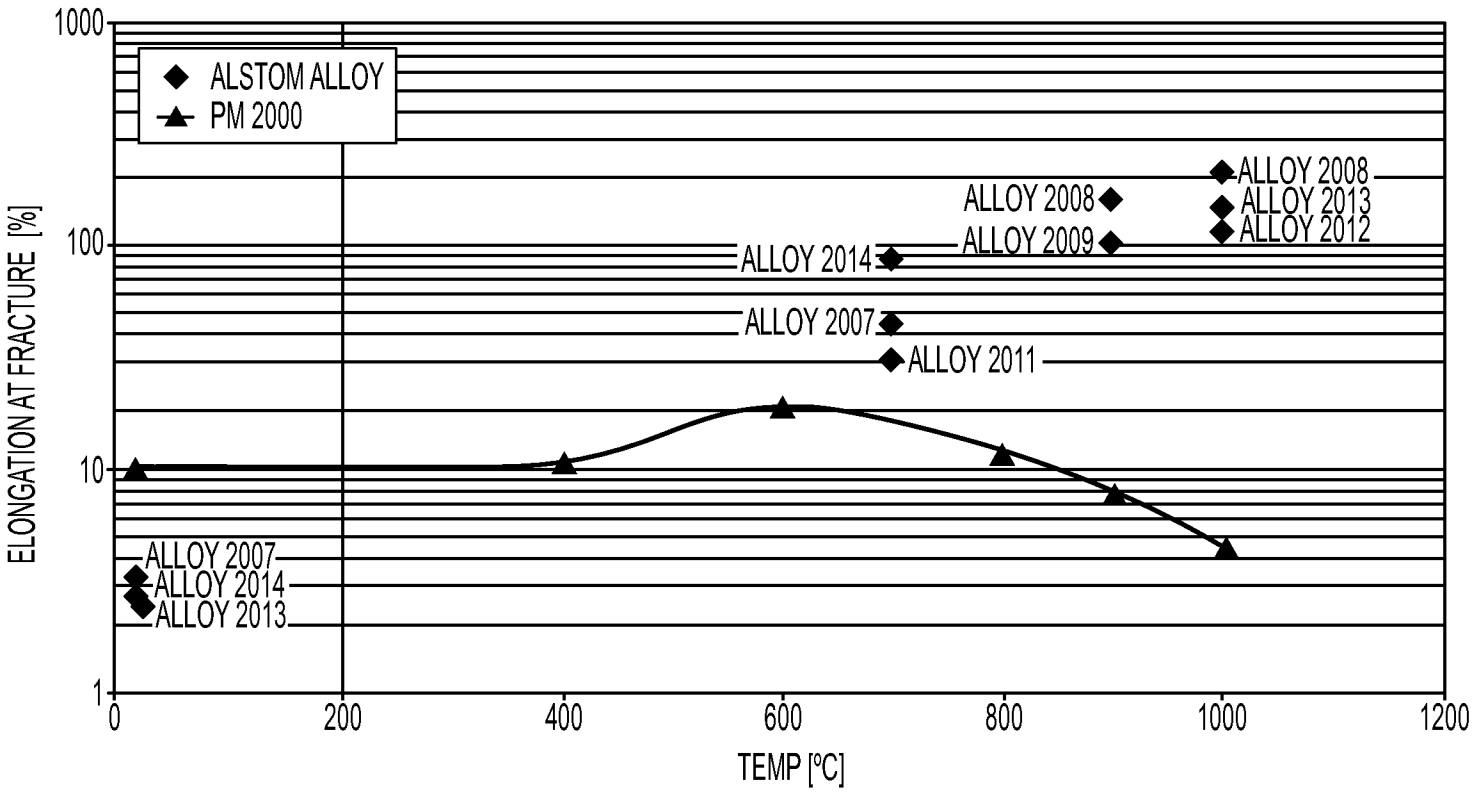
FIG. 5 shows the elongation to fracture in the range from room temperature to 1000° C. for PM 2000 and for selected materials according to the invention.

In FIGS. 3 to 5, the results of tensile tests in the temperature range from room temperature to 1000° C. are represented.

FIG. 3 shows the dependence of the tensile strength on temperature for the material specified. At room temperature, the values of the materials investigated are relatively close together. Some of the materials according to the invention (for example alloys 2007 and 2013) are stronger at room temperature than the materials known from the prior art, but with others there are scarcely any differences from the known alloys PM 2000 and Kanthal APM.

To about 400° C., the temperature-dependent tensile strength values remain approximately constant, after that they drop markedly, as expected. In the temperature range from 900 to 1000° C., the investigated alloys according to the invention all have higher tensile strengths than Kanthal APM and somewhat lower tensile strengths than PM 2000. If, however, this is combined with the outstanding oxidation behavior of these alloys at 1000° C. (see FIG. 2), these are very good combinations of properties.

In FIG. 4, the dependence of the yield strength on temperature is represented. The tendency corresponds approximately to the progression of the tensile strengths according to FIG. 3.

Finally, FIG. 5 shows the dependence of the elongation to fracture on the temperature in the range from room temperature to 1000° C. For PM 2000, the elongation to fracture values are approximately constant in the range from RT to 400° C., with a maximum at 600° C. of double the value in comparison with RT, after which the elongation to fracture values drop again as the temperature increases, until at 1000° C. about half the value at RT is reached. The increase in ductility of PM 2000 at about 600° C. is attributable to the softening of the material.

While at room temperature the elongations to fracture of the alloys according to the invention lie below the values for PM 2000, from about 600° C. they are all higher. This positive effect is attributable to the interaction of the material constituents in the ranges specified.

The materials according to the invention are also well suited for hot rolling and have good plastic deformability.

They can be used very well as a protective tube for thermocouples, the latter being used for example in gas turbines with sequential combustion for temperature control and exposed there to oxidizing atmospheres.

To sum up, it can be stated that the alloys according to the invention have very good oxidation resistance at 1000° C. They have better mechanical properties than the alloy known from the prior art Kanthal APM. Although the strength values of the alloys according to the invention are somewhat lower than those of the alloy PM 2000, the ductility is much better. At 1000° C., the oxidation resistance is also more than twice as high as with PM 2000. Since the alloys according to the invention are also less expensive than PM 2000 (less expensive constituents, simpler production), they are outstandingly suitable as a substitute for PM 2000 for the areas of use described above.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An iron-based high-temperature alloy, comprising the following chemical composition, with values in % by weight:

20 Cr,
4 to 8 Al,
at least one of Ta and Mo, wherein the sum (Ta+Mo)=4 to 8,
0-0.2 Zr,
0.02-0.05 B,
0.1-0.2 Y,
0.25-0.5 Si,
remainder Fe.

2. The high-temperature alloy as claimed in claim 1, comprising 5 to 6% by weight Al.

3. The high-temperature alloy as claimed in claim 2, comprising 5.5 to 6% by weight Al.

4. The high-temperature alloy as claimed in claim 1, comprising 0 to 8% by weight Mo and/or 0 to 4% by weight Ta, wherein the sum (Mo+Ta) is in the range from 4 to 8% by weight.

5. The high-temperature alloy as claimed in claim 4, comprising 2% by weight Mo and 2% by weight Ta.

6. The high-temperature alloy as claimed in claim 4, comprising 4% by weight Mo and/or 4% by weight Ta.

7. The high-temperature alloy as claimed in claim 1, comprising 0.25% by weight Si.

8. The high-temperature alloy as claimed in claim 1, comprising 0.5% by weight Si.

9. The high-temperature alloy as claimed in claim 1, comprising 0.2% by weight Zr.

10. The high-temperature alloy as claimed in claim 1, comprising 0.05% by weight B.

11. The high-temperature alloy as claimed in claim 1, comprising 0.1% by weight Y.

12. A method for producing a high-temperature alloy, the method comprising:

providing the following elements, with values in % by weight,
20 Cr,
4 to 8 Al,
at least one of Ta and Mo, wherein the sum (Ta+Mo)=4 to 8,
0-0.2 Zr,
0.02-0.05 B,
0.1-0.2 Y,
0.25-0.5 Si,
remainder Fe;

melting said elements by an arc to form an alloy; and after said melting, rolling said alloy at about 800-900° C.

13. A method of protecting a thermocouple, the method comprising:

providing an alloy as claimed in claim 1;

forming a tube from said alloy; and positioning said thermocouple in said tube.

* * * * *